US006257496B1

(12) United States Patent
Wyant

(10) Patent No.: US 6,257,496 B1
(45) Date of Patent: Jul. 10, 2001

(54) FUEL INJECTOR HAVING AN INTEGRATED SEAT AND SWIRL GENERATOR

(75) Inventor: Gordon Wyant, Hampton, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/471,614

(22) Filed: Dec. 23, 1999

(51) Int. Cl.[7] ..... F02D 1/06; B05B 1/30; B05B 1/34

(52) U.S. Cl. ..... 239/5; 239/473; 239/492; 239/533.12; 239/585.1; 239/585.4; 29/890.122; 29/890.143

(58) Field of Search ..... 239/1, 5, 461, 239/463, 468, 472, 473, 494, 496, 497, 585.1, 585.4, 585.5, 533.11, 533.12, 492, 590.3, 584, 490, 491, 890.143, 890.122

(56) References Cited

U.S. PATENT DOCUMENTS

| | | | | |
|---|---|---|---|---|
| 1,582,080 | * | 4/1926 | Peabody | 239/492 |
| 2,273,830 | | 2/1942 | Brierly et al. | 29/157 |
| 2,508,788 | * | 5/1950 | Hallinan | 239/492 |
| 4,120,456 | | 10/1978 | Kimura et al. | 239/464 |
| 4,643,359 | | 2/1987 | Casey | 239/585 |
| 5,114,077 | | 5/1992 | Cerny | 239/483 |
| 5,207,384 | | 5/1993 | Horsting | 239/463 |
| 5,271,563 | | 12/1993 | Cerny | 239/533.2 |
| 5,409,169 | | 4/1995 | Saikalis et al. | 239/404 |
| 5,462,231 | | 10/1995 | Hall | 239/585.4 |
| 5,494,224 | | 2/1996 | Hall et al. | 239/585.5 |
| 5,625,946 | | 5/1997 | Wildeson et al. | 29/888.41 |
| 5,630,400 | | 5/1997 | Sumida et al. | 123/470 |
| 5,636,796 | | 6/1997 | Oguma | 239/533.12 |
| 5,871,157 | | 2/1999 | Fukutomi et al. | 239/463 |
| 5,875,972 | | 3/1999 | Ren et al. | 239/463 |
| 6,024,301 | * | 2/2000 | Hurley et al. | 239/492 |

FOREIGN PATENT DOCUMENTS

| | | |
|---|---|---|
| WO 09910649 A1 | 3/1999 | (DE) . |
| WO 99/10648 | 3/1999 | (DE) . |
| WO 9910649 | 3/1999 | (DE) . |
| 2 140 626 A | 4/1984 | (GB) . |
| 0241973 | 9/1990 | (JP) . |

OTHER PUBLICATIONS

*Geometrical Effects on Flow Characteristics of Gasoline High Pressure Direct Injecter,* W.M. Ren, J. Shen, J.F. Nally Jr., p. 1–7, (97FL–95).

* cited by examiner

*Primary Examiner*—David A. Scherbel
*Assistant Examiner*—Steven J. Ganey

(57) ABSTRACT

A fuel injector with a body having an inlet portion, an outlet portion, and a fuel passageway extending from the inlet portion to the outlet portion along a longitudinal axis. An armature proximate the inlet portion of the body. A needle operatively connected to the armature. A seat is located proximate the outlet portion of the body. The seat includes a first surface, a second surface, a seat passage extending between the first surface and the second surface in the direction of the longitudinal axis, and a swirl generator formed in the first surface that communicates with the passage. A flat disk, which is located proximate the first surface, includes an aperture that guides the needle and at least one opening that communicates with the swirl generator of the seat. The flat disk combined with the seat provide a seat, swirl generator, and needle guide combination.

16 Claims, 3 Drawing Sheets

FUEL INJECTOR HAVING AN INTEGRATED SEAT AND SWIRL GENERATOR

FIELD OF INVENTION

This invention relates to fuel injectors in general and particularly high-pressure, direct-injection fuel injectors. More particularly, high-pressure, direct-injection fuel injectors having a swirl generator within the body of the fuel injector.

BACKGROUND OF THE INVENTION

It is known in the art relating to high-pressure direct injection fuel injectors to have a swirl generator and needle guide positioned proximate a seat in a body. In known systems, seat, swirl generator, and needle guide combinations include a plurality of structural members. For example, commonly assigned U.S. Pat. No. 5,875,972 discloses two separate flat disks adjacent a seat to provide a swirl generator and a needle guide. The flat disks are thin sheet metal members that are believed to produce minimal drag on the needle of the fuel injector. To assemble this arrangement of the seat, swirl generator, and needle guide seat combination requires each of the three components to be sequentially aligned and laser welded together. Due to the numerous individual assembly steps required, misalignments can occur with the multiple components.

Another manufacturing difficulty that could result from the three components used to form the seat, swirl generator, and needle guide combination is the need to develop new assembly steps for changes in the swirl disk configuration. The three component combination employs an individual flat swirl disk between a flat guide disk and a seat as the swirl generator. Changes in swirl disk thickness size due to varying fuel swirl requirements for selected direct fuel injection applications requires the assembly steps to be reconfigured. A known two component seat, swirl generator and needle guide combination, described in U.S. Pat. No. 5,871,157, has been developed that addresses some of the assembly difficulties of the three component combination. Although some of the assembly difficulties the three component combination may have been overcome, the swirl generator and needle guide component employed in known two component combination is believed to create a large drag point for the employed needle valve. Thus, there is a need for a two component seat, swirl generator, and needle guide combination that minimizes drag forces applied to the needle valve.

SUMMARY OF THE INVENTION

The present invention provides a fuel injector with a body having an inlet, an outlet, and a fuel passageway extending from the inlet to the outlet along a longitudinal axis. An armature is located proximate the inlet of the body. A needle is operatively connected to the armature. A seat is located proximate the outlet of the body. The seat includes a first surface, a second surface, and a passage extending between the first surface and the second surface in the direction of the longitudinal axis. The seat further includes an integrated swirl generator formed in the first surface that communicates with the passage. A flat disk is located proximate the first surface. The flat disk includes an aperture that guides the needle and at least one opening that communicates with the swirl generator of the seat.

In a preferred embodiment of the invention, the swirl generator has at least one channel that is substantial tangent to a periphery of the passage, and a feeder proximate the at least one channel, the feeder comprising a geometric volume formed in the first surface of the seat between the periphery of the passage and a circumference of the first surface.

The present invention also provides a seat with a first surface, an outer circumference engaging the first surface, a second surface engaging the outer circumference, a passage extending between the first surface and the second surface, and a swirl generator formed in the first surface that communicates with the passage.

The present invention further provides a method of forming a seat, swirl generator, and needle guide combination. The method comprising the steps of providing a seat with a first surface, a second surface, and a passage extending between the first surface and the second surface; forming a swirl generator in the first surface that communicates with the passage; locating a flat disk with an aperture and an opening on the first surface of the seat; aligning the opening of a flat disk with the feeder of the swirl generator; and welding the flat disk to the seat.

The present invention also provides a method of forming a seat with an integrated swirl generator. The method comprising the steps of providing a seat with a first surface, a second surface, and a passage extending between the first surface and the second surface; and forming a swirl generator in the first surface that communicates with the passage.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1:
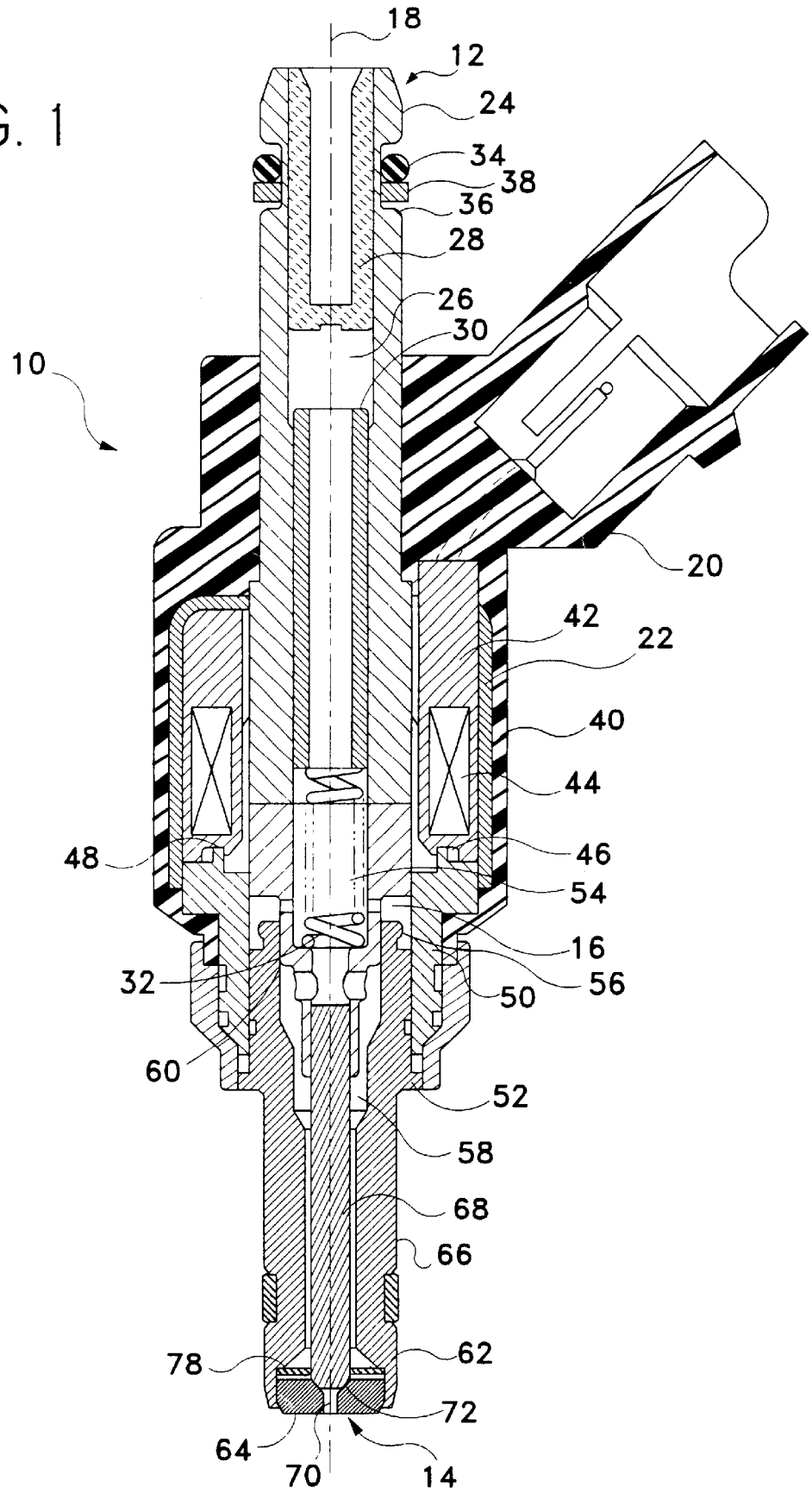
FIG. 1 is a cross-sectional view of the fuel injector of the present invention taken along its longitudinal axis.

FIG. 1 illustrates a preferred embodiment of the fuel injector 10, in particular a high-pressure, direct-injection fuel injector 10. The fuel injector 10 has a housing, which includes a fuel inlet 12, a fuel outlet 14, and a fuel passageway 16 extending from the fuel inlet 12 to the fuel outlet 14 along a longitudinal axis 18. The housing includes an overmolded plastic member 20 cincturing a metallic support member 22.

A fuel inlet member 24 with an inlet passage 26 is disposed within the overmolded plastic member 20. The inlet passage 26 serves as part of the fuel passageway 16 of the fuel injector 10. A fuel filter 28 and an adjustable tube 30 is provided in the inlet passage 26. The adjustable tube 30 is positionable along the longitudinal axis 18 before being secured in place to vary the length of an armature bias spring 32, which control the quantity of fluid flow within the injector. The overmolded plastic member 20 also supports a socket that receives a plug (not shown) to operatively connect the fuel injector 10 to an external source of electrical potential, such as an electronic control unit ECU (not shown). An elastromeric o-ring 34 is provided in a groove on an exterior extension of the inlet member. The o-ring 34 is biased by a flat spring 38 to sealingly secure the inlet source with a fuel supply member, such as a fuel rail (not shown).

The metallic support member 22 encloses a coil assembly 40. The coil assembly 40 includes a bobbin 42 that retains a coil 44. The ends of the coil assembly 40 are operatively connected to the socket through the overmolded plastic member 20. An armature 46 is axially aligned with the inlet member by a spacer 48, a body shell 50, and a body 52. The armature 46 has an armature passage 54 aligned along the longitudinal axis 18 with the inlet passage 26 of the inlet member.

The spacer 48 engages the body 52, which is partially disposed within the body shell 50. An armature guide eyelet 56 is located on an inlet portion 60 of the body 52. An axially extending body passage 58 connects the inlet portion 60 of the body 52 with an outlet portion 60 of the body 52. The armature passage 54 of the armature 46 is axial aligned with the body passage 58 of the body 52 along the longitudinal axis 18. A seat 64, which is preferably a metallic material, is located at the outlet portion 62 of the body 52.

The body 52 has a neck portion 66, which is, preferably, a cylindrical annulus that surrounds a needle 68. The needle 68 is operatively connected to the armature 46, and is, preferably, a substantially cylindrical needle 68. The cylindrical needle 68 is centrally located within the cylindrical annulus. The cylindrical needle 68 is axially aligned with the longitudinal axis 18 of the fuel injector 10.

Operative performance of the fuel injector 10 is achieved by magnetically coupling the armature 46 to the inlet member 24 near the inlet portion 60 of the body 52. A portion of the inlet member 24 proximate the armature 46 serves as part of the magnetic circuit formed with the armature 46 and coil assembly 40. The armature 46 is guided by the armature guide eyelet 56 and is responsive to an electromagnetic force generated by the coil assembly 40 for axially reciprocating the armature 46 along the longitudinal axis 18 of the fuel injector 10. The electromagnetic force is generated by current flow from the ECU through the coil assembly 40. Movement of the armature 46 also moves the operatively attached needle 68. The needle 68 engages the seat 64, which opens and closes the seat passage 70 of the seat 64 to permit or inhibit, respectively, fuel from exiting the outlet of the fuel injector 10. The needle 68 includes a curved surface 72, which is preferably a spherical surface, that mates with a conical end 74 of a funnel 76 that serves as the preferred seat passage 70 of the seat 64. A further detailed description of the interaction of the curved surface of the needle and the conical end of the funnel is provided in commonly assigned U.S. Pat. No. 5,875,972, which is expressly incorporated herein in its entirety by reference. During operation, fuel flows in fluid communication from the fuel inlet source (not shown) through the inlet passage 26 of the inlet member 24, the armature passage 54 of the armature 46, the body passage 58 of the body 52, and the seat passage 70 of the seat 64 to be injected from the outlet 14 of the fuel injector 10.

The seat 64 has a first surface 78 and a second surface 80. The second surface 80 is offset from the first surface 78 along the longitudinal axis 18 and is substantially parallel to the first surface 78. The seat passage 70 extends between the first surface 78 and the second surface 80 in the direction of the longitudinal axis 18. A swirl generator 82 is formed in the first surface 78 that communicates with the seat passage 70. The swirl generator 82 formed in first surface 78 of the seat 64 is exposed to the body passage 58, and allows fuel to form a swirl pattern on the funnel 70, which serves as the seat passage 70. With the formation of the swirl generator 82 in the first surface 78 of the seat 64, an integrated seat 64 and swirl generator 82 for the fuel injector 10 is provided.

Figure 2:
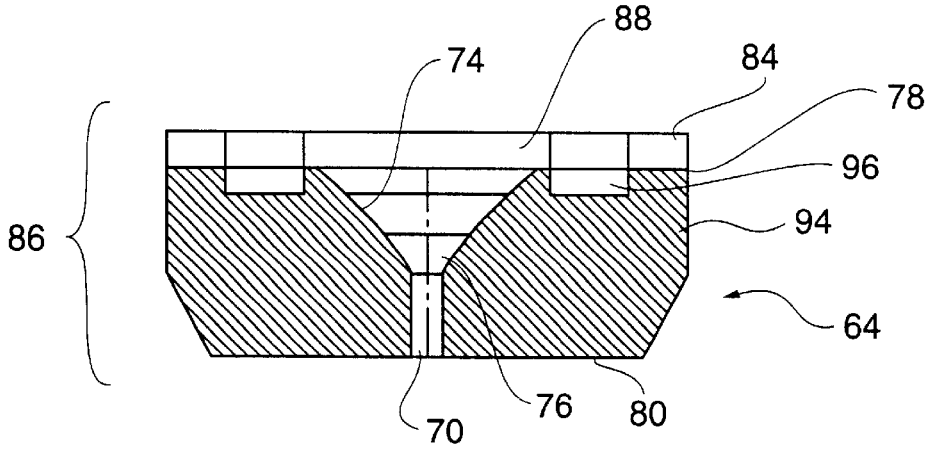
FIG. 2 is an enlarged cross-sectional view of the two component seat, swirl generator, and needle guide combination of the fuel injector shown in FIG. 1.
Figure 5:
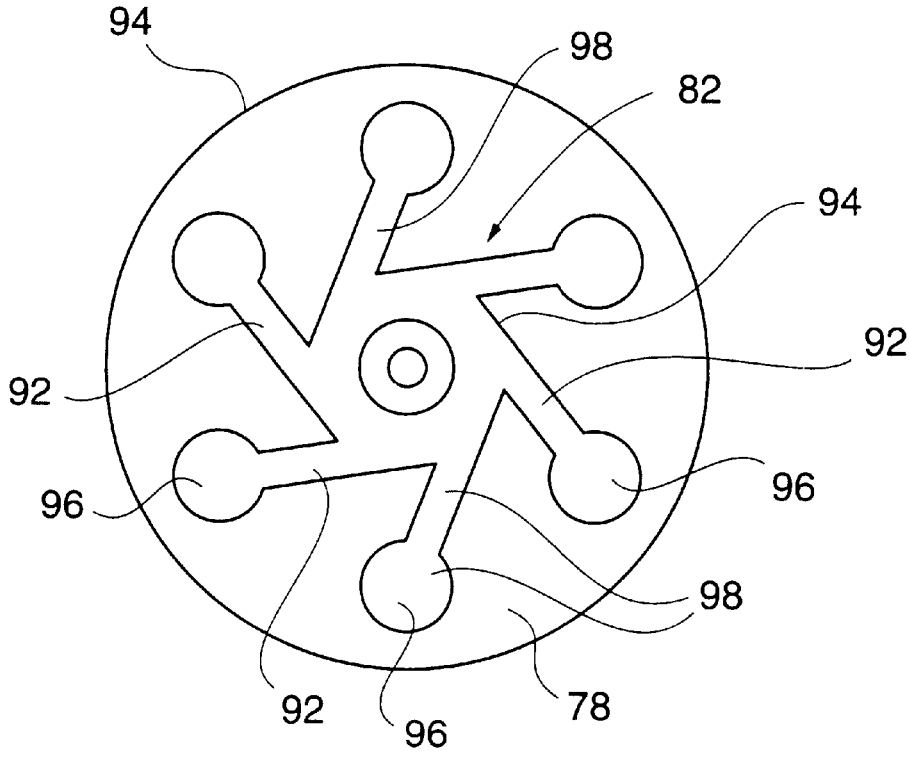
FIG. 5 is a top view of the integrated seat and swirl generator of the two component combination shown in FIG. 3.
Figure 4:
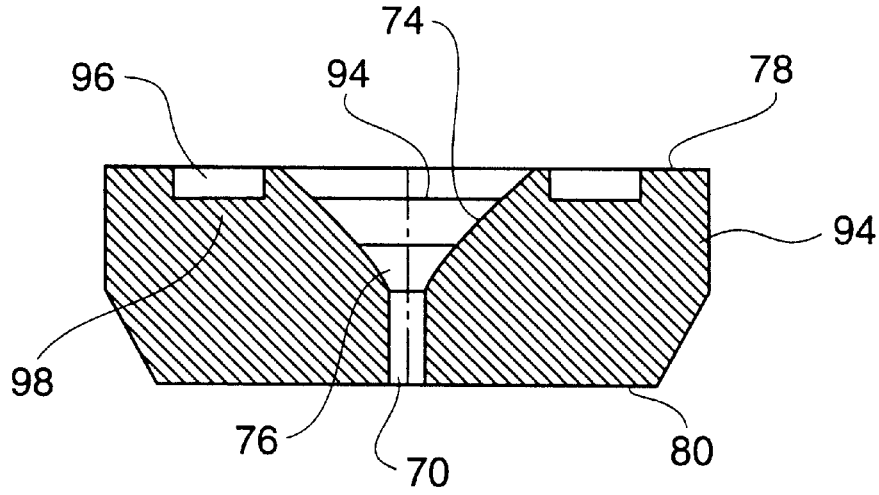
FIG. 4 is an enlarged cross-sectional view of the integrated seat and swirl generator of the two component combination shown in FIG. 2.

A flat disk 84 is located proximate the first surface 78 of the seat 64. As shown in FIG. 2, the flat disk 84 combined with the integrated seat 64 and swirl generator 82 provide the preferred embodiment of the two component seat, swirl generator, and needle guide combination 86. The flat disk 84 has an aperture 88 that guides the needle 68 and at least one opening 90 that communicates with the swirl generator 82 of the seat 64. The flat disk 84, in the preferred embodiment, is a sheet metal member with a thickness of approximately 0.5 mm. The thickness of the flat disk 84 provides an axial bearing surface for the aperture 88 that guides the needle 64 with minimal drag.

The swirl generator 82 has at least one channel 92 that is substantial tangent to a periphery of the seat passage 70. The at least one channel 92 forms a ledge 94 proximate a boundary of the funnel 76. The at least one channel 92, preferably, is a plurality of channels 92 disposed about the boundary of the funnel 76. The plurality of channels 92 is uniformly disposed about the boundary of the funnel 76. In the preferred embodiment, there are six channels 92. Each of the channels 92 extends tangentially from an area in the first surface 78 between an outer circumference 94 of the seat 64 and the funnel 76, and provides a tangential fuel flow path through the swirl generator 82 to a needle 68.

A feeder 96, corresponding to each of the plurality of channels 92, is uniformly disposed in the first surface 78 between the boundary of the funnel 76 and the outer circumference 94. Each feeder 96 is a geometric volume formed in the first surface 78 of the seat 64 between the boundary of the funnel 76 and the outer circumference 94. In the preferred embodiment, there are six feeders 96, which corresponds to the six channels 92.

Each of the channels 92 and feeders 96 of the swirl generator 82 are, preferably, laser machined into the first surface 78 so that a base portion 98 of each of the channels and feeders is at an appropriate distance from the first surface 78 so that fluid flows toward the funnel 76 of the seat 64. Each of the channels 92 and feeders 96 has a particular configuration depending on the selected fuel injector application. For example, the channel 92 can have a polygon cross-section with one of the sides of the polygon serving as the base portion 98, or a semicircular cross-section with the apex of the semicircle positioned as the base portion 98. The selected cross-section can have an uniform or varied width along the length of the channel 92. For example, for a selected application, the width of the cross-section can increase as the channel 92 extends from the feeder 96 to the boundary of the funnel 76. The feeder 96 has at least one side of the geometric volume formed in the first surface 78 that serves at the base portion 98. For example, in the preferred embodiment, the geometric volume is a cylinder, and an end of the cylinder provides the base portion 98. The base portion 98 of the feeder 96 and the base portion 96 of the channel 92 are, preferably, formed as one continuous surface.

The distance of base portion 98 of each channel 92 from the first surface 78 is, preferably, uniform. That is, the distance of the base portion 98 of each channel 92 from the first surface 78 is the same along its entire length of the channel 92. More particularly, the distance from the first surface 78 to the base portion 98 is the same as the distance from the first surface 78 to the boundary of the funnel 76. Similarly, the base portion 98 of each feeder 96 is also laser machined the same distance from the first surface 78 as the boundary of the funnel 76.

Alternatively, the base portion 98 along the length of the channel 92 could be formed so that the distance between the first surface 78 and the base portion 98 varies over the length of the channel 92. With the varying distance of the base portion 98, the channel 92 can be sloped between the feeder 96 and the boundary of the funnel 76. To achieve the sloped arrangement, the base portion 98 of the feeder 96 should be located a fraction of the distance between the first surface 78 and the boundary of the funnel 76. In addition to the sloped channel 92, the base portion 98 of the feeder 96 can also be sloped by varying the distance areas of the base portion 98 of the feeder 96 are located from the first surface 78.

With either or both of the feeder and the channel having uniform or sloped base portions, and uniform or varied cross-sectional configuration widths along the length of the channel, different swirl generator 82 configurations can be readily provided in the first surface 78 of the seat 64. Because the axial distance between the first surface 78 and the second surface 80 of the seat 64 is selected to a predetermined value that remains the same for each of the different swirl generator 82 configurations formed in the first surface 78, assembly of the preferred two component seat, swirl generator, and needle guide combination 86 can be standardized. That is, different swirl generators can be employed without having to change the process for securing, particularly, by laser welding, the flat disk 84 to the seat 64.

Figure 3:
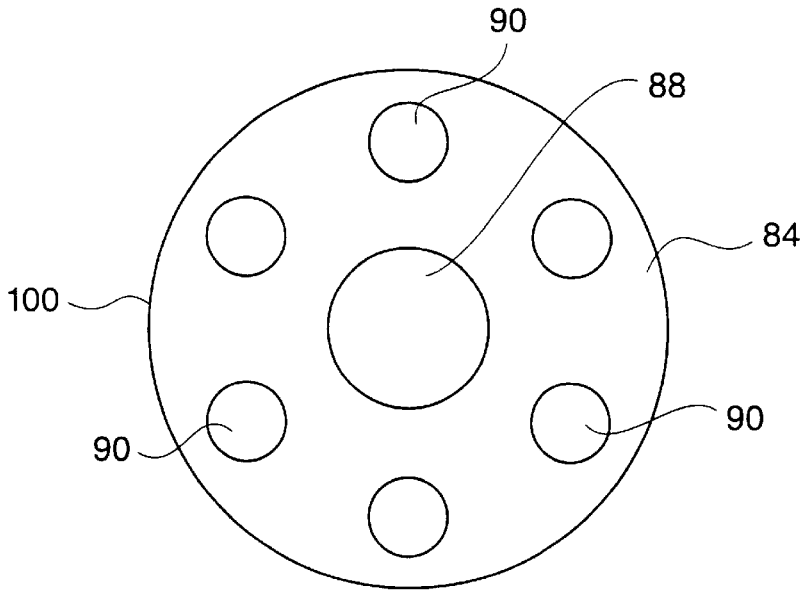
FIG. 3 is a top view of the guide disk of the two component combination shown in FIG. 2.

The flat disk 84 provides aperture 88 as the needle guide. The flat disk 84 also includes the at least opening 90 that communicates with the swirl generator 82, and, in particular, one of the feeders 96. The at least one opening 90 of the flat disk 84, preferably, is a plurality of openings 90 corresponding to the number of feeders 96 provided in the first surface 78. As shown in FIG. 3, the plurality of openings 90 is uniformly disposed between the aperture 88 and a circumference 100 of the flat disk 84. Each of the plurality of openings 90 has a geometric configuration that corresponds to the geometric volume of the feeder 96. Although various geometric shapes could be selected, the preferred geometric configuration of the plurality of openings 90 is a circle, which readily aligns with the preferred cylindrical geometric volume of the feeder 96. The openings 90 supply fuel from the body passage 58 to the swirl generator 82 integrated in the seat 64.

The integrated seat 64 and swirl generator 82 allow for a method of forming a seat, swirl generator, and needle guide combination 86. To achieve the method, a seat 64, with a first surface 78, a second surface 80, and a seat passage 70 extending between the first surface 78 and the second surface 80 is provided. Then, a swirl generator 82 is formed in the first surface 78 that communicates with the seat passage 70.

In a preferred embodiment, the swirl generator 82 is formed by laser machining at least one channel 92 and feeder 96 in the first surface 78. More particularly, the preferred embodiment includes a plurality of channels 92 and feeders 96 formed in the first surface 78 by laser machining.

The laser machining of the channels 92 and feeders 96 that form the swirl generator 82 is, preferably, achieved by employing a copper vapor laser, however, any laser machining technique that can accomplish micro-machining could be used. The copper vapor laser is used to micro-machine the metal employed for the seat 64. The seat 64 is, preferably, stainless steel, and is micro-machined by the copper vapor laser with minimal thermal distortion. A copper vapor laser capable of forming the details of the swirl generator 82 in the first surface 78 is currently commercially available.

After the swirl generator 82 is formed, the flat disk 84 with an aperture 88 and at least an opening 90 is located on the first surface 78 of the seat 64. As flat disk 84 is located on the first surface 78, the openings 90 of a flat disk 78 are aligned with the feeders 96 of the swirl generator 82. Then, the flat disk 84 is laser welded to the seat 64.

Forming a seat 64 with an integrated swirl generator 82 provides a novel method. To achieve the method, a seat 64 with a seat passage 70 extending between a first surface 78 and second surface 80 is provided, and, then, a swirl generator 82, which communicates with the seat passage 70, is formed in the first surface 78.

Preferably, the swirl generator 82 is formed by laser machining at least one channel 92 in the first surface 78 substantial tangent to a periphery of the seat passage 70. Also, in the preferred embodiment, a geometric volume is formed proximate the at least one channel between the periphery of the passage 70 and a circumference of the seat by laser machining of the first surface 78 so that the geometric volume serves as a feeder 96 for the at least one channel 92. A funnel 76 is, preferably, provided as the seat passage 70 between the first surface 78 and the second surface 80 of the seat 64.

While the invention has been disclosed with reference to certain preferred embodiments, numerous modifications, alterations, and changes to the described embodiments are possible without departing from the sphere and scope of the invention, as defined in the appended claims. Accordingly, it is intended that the invention not be limited to the described embodiments, but that it have the full scope defined by the language of the following claims and equivalents thereof.

I claim:

1. A fuel injector comprising:

a body having an inlet portion, an outlet portion, and a fuel passageway extending from the inlet portion to the outlet portion along a longitudinal axis;

an armature proximate the inlet portion of the body;

a needle operatively connected to the armature;

a seat proximate the outlet portion of the body; the seat including a first surface, a second surface, a seat passage extending between the first surface and the second surface in the direction of the longitudinal axis, and a swirl generator formed in the first surface that communicates with the seat passage;

a flat disk proximate the first surface, the flat disk including an aperture that guides the needle and at least one opening that communicates with the swirl generator of the seat.

2. The fuel injector of claim 1, wherein the swirl generator comprises at least one channel that is substantial tangent to a periphery of the passage.

3. The fuel injector according to claim 2, wherein the swirl generator further comprises a feeder proximate the at least one channel, the feeder comprising a geometric volume formed in the first surface of the seat between the periphery of the passage and a circumference of the first surface.

4. The fuel injector of claim 3, wherein the swirl generator is laser machined into the first surface.

5. The fuel injector of claim 3, wherein the number of channels comprises six.

6. The fuel injector of claim 1, wherein the seat passage comprises a funnel between the first surface and the second surface.

7. The fuel injector of claim 6, wherein the swirl generator comprises at least one channel that forms a ledge proximate a boundary of the funnel.

8. The fuel injector of claim 7, wherein the at least one channel of the swirl generator comprises a plurality of channels disposed about the boundary of the funnel.

9. The fuel injector of claim 8, wherein the plurality of channels is uniformly disposed about the boundary of the funnel.

10. The fuel injector of claim 9, wherein a corresponding feeder for each of the plurality of channels is uniformly disposed in the first surface between the boundary of the funnel and a circumference of the first surface.

11. The fuel injector of claim 10, wherein the at least one opening of the flat disk comprises a plurality of openings corresponding to the number of feeders provided in the first surface, the plurality of openings being uniformly disposed between the aperture and a circumference of the flat disk.

12. The fuel injector of claim 11, wherein the plurality of openings comprise a geometric configuration that corresponds to the geometric volume of the feeder.

13. The fuel injector of claim 12, wherein the geometric configuration of the plurality of openings comprises a circle and the geometric volume of the feeder comprises a cylinder.

14. A method of forming a seat, swirl generator, and needle guide combination, comprising:

providing a seat with a first surface, a second surface, and a seat passage extending between the first surface and the second surface;

forming a swirl generator in the first surface comprising at least one feeder that communicates with the seat passage;

locating a needle guide comprising a flat disk with an aperture and an opening on the first surface of the seat;

aligning the opening of the flat disk with the at least one feeder of the swirl generator; and welding the flat disk to the seat.

15. The method of claim 14, further comprising:

forming the swirl generator by laser machining at least one channel and the at least one feeder in the first surface.

16. The method of claim 14, further comprising:

forming the swirl generator by forming a plurality of channels and feeders in the first surface by laser machining.

* * * * *